US005829201A

United States Patent [19]

Schelter et al.

[11] Patent Number: 5,829,201

[45] Date of Patent: Nov. 3, 1998

[54] THEATER WITH SEAT AND WHEELCHAIR PLATFORM MOVEMENT

[75] Inventors: James Schelter, Universal City, Calif.; Frank Masi, Las Vegas, Nev.

[73] Assignee: Universal City Studios, Inc., Universal City, Calif.

[21] Appl. No.: 834,328

[22] Filed: Apr. 15, 1997

[51] Int. Cl.[6] ..... A47C 1/12; A63J 5/12; A63G 31/00; E04H 3/28

[52] U.S. Cl. ..... 52/9; 52/10; 52/8; 414/921; 472/60; 472/76

[58] Field of Search ..... 52/8–10; 472/59, 472/60, 76; 297/344.1, 344.12, 344.15, 344.17, 52, 472; 414/921; 187/901

[56] References Cited

U.S. PATENT DOCUMENTS 1,517,774 12/1924 Duprey .
3,923,300 12/1975 Tanus .
4,874,162 10/1989 Trumbull et al. .
4,879,849 11/1989 Hollingsworth, III et al. .
4,885,878 12/1989 Wuu .
5,165,389 11/1992 Jing-Qi et al. .
5,499,920 3/1996 Trumbull .
5,513,990 5/1996 Gluck .
5,517,789 5/1996 Sugiyama .
5,564,985 10/1996 Engstrand .
5,567,157 10/1996 Salmon, Jr. et al. .

*Primary Examiner*—Robert Canfield
*Attorney, Agent, or Firm*—Lyon & Lyon LLP

[57] ABSTRACT

An amusement attraction has a theater with an audience seating area. The audience seating area faces a projection screen and a film presentation is projected onto the projection screen. The audience seating area contains seats that are arranged in rows. The seats are supported on seat drop units that vertically shift the seats. The theater also contains wheelchair platforms that are installed between some of the seats. The wheelchair platforms are also capable of moving in a vertical direction. During a predetermined sequence in the film presentation, an explosion takes place on the projection screen, and the seats and the wheelchair platforms drop suddenly to simulate the theater floor being blown out. In this manner, the audience, including members of the audience who are physically disabled, is provided with a participatory theater experience.

17 Claims, 4 Drawing Sheets

Fig. 2
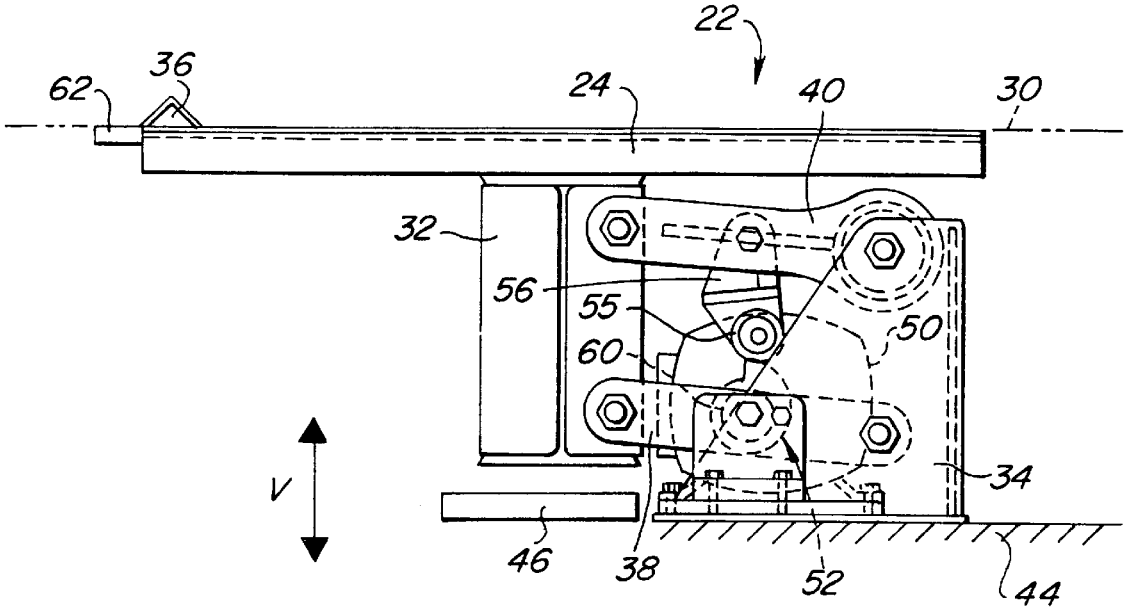
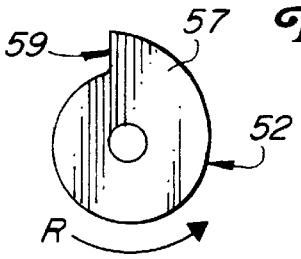
Fig. 2A

THEATER WITH SEAT AND WHEELCHAIR PLATFORM MOVEMENT

BACKGROUND OF THE INVENTION

The field of the invention is amusement/theme park attractions. More particularly, the invention relates to an amusement attraction that offers a participatory theater experience to all guests, including guests with physical disabilities.

Theaters, arenas and other theater-like facilities that provide wheelchair access and have designated areas where guests in wheelchairs can view a film, sporting event, concert, show, etc. are well known. Such designated wheelchair access areas are generally created by not installing or removing seats in a particular section of the facility.

Various amusement attractions or theaters have also provided a participatory theater experience by moving the theater seats. Different techniques have been used, including mounting entire rows of seats onto a motion platform. Other designs have used vibrators and actuators to provide vibration and rhythmic seat movement. However, none of these attractions offer the same participatory experience to a person in a wheelchair as that enjoyed by others. While these attractions may have met with varying degrees of success, none of them appear to contemplate accommodating participants having physical disabilities. Consequently, the physically disabled have been largely excluded from many types of theater or attraction experiences. Thus, there remains a need for amusement attractions that offer participatory theater experience to all guests, including guests with physical disabilities.

SUMMARY OF THE INVENTION

To these ends, the present attraction provides a participatory theater experience to all guests, including guests with physical disabilities.

In the preferred embodiment, a theater has an audience seating area, a projection screen in front of the audience seating area and a projector for projecting a film onto the projection screen. The audience seating area advantageously includes seats supported on seat drop units which can shift the seats in a vertical direction. The seat drop units are most desirably installed beneath the floor of the theater. The theater also contains one or more platforms designed for wheelchairs. The wheelchair platforms are also supported on a drop unit which can move in a vertical direction. The drop units are preferably controlled to quickly drop the seats and platform at a specific time during the film presentation. The audience experiences a sudden dropping of each chair and wheelchair platform.

Special effects in the theater, such as lighting and fog effects, may be provided to enhance the participatory experience.

Accordingly, it is an object of the invention to provide an amusement or theater attraction that offers a participatory theater experience to all guests including the physically disabled.

BRIEF DESCRIPTION OF THE DRAWINGS

In the drawings, wherein similar reference characters denote similar elements throughout the several views:

FIG. 2 is a side elevation view of a wheelchair platform on a drop unit;

FIG. 2A is a side elevation view of the cam shown in FIG. 2;

DETAILED DESCRIPTION

Figure 1:
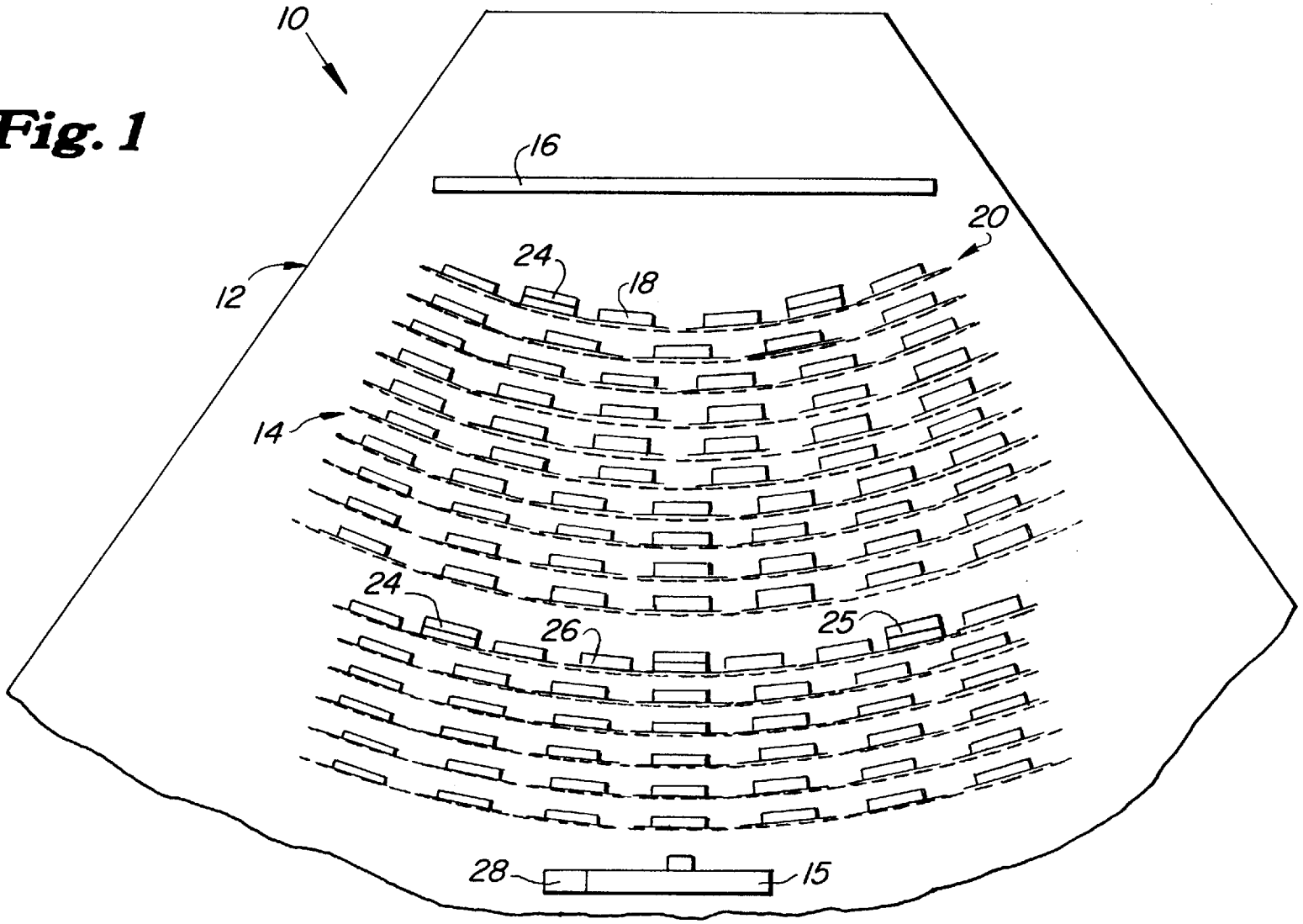
FIG. 1 is a schematic plan view of the audience seating area of the present invention.

Referring now to the drawings, as shown in FIG. 1, an amusement attraction 10 includes a theater 12 with an audience seating area 14. The audience seating area 14 faces a projection screen 16. Motion pictures are projected onto the screen 16 via a projection system 15. The audience seating area 14 contains seats 18 arranged in rows 20. The seats 18 are supported on drop units 22 that are capable of moving in a vertical direction. In the preferred embodiment, the rows 20 are grouped into two section. In front of each section, wheelchair platforms 24 are installed between some of the seats 18. The wheelchair platforms 24 are also supported on drop units for vertical movement. The platforms have a rear stop 36 for positioning or securing a wheelchair onto the platform.

Advantageously, there is also a fixed section of seats 26 and at least one fixed wheelchair platform 25 that are stationary to accommodate guests who do not desire a participatory experience for medical or other reasons. The remaining (movable) seats 18 and the wheelchair platforms 24 are selectively operated via a controller 28. Any section of seats 18 or any wheelchair platform 24 within the theater 12 (other than the fixed seats and platform(s), if any) can be separately set to move or to remain stationary by the controller 28. The controller 28 is linked to the projection system 15.

Figure 4:
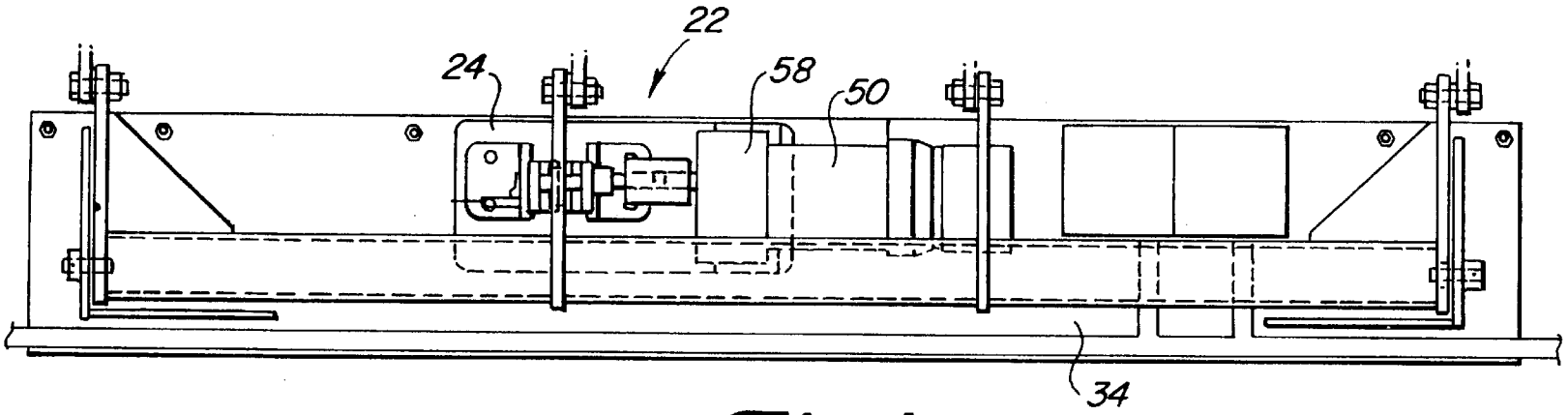
FIG. 4 is a plan view of a drop unit.
Figure 5:
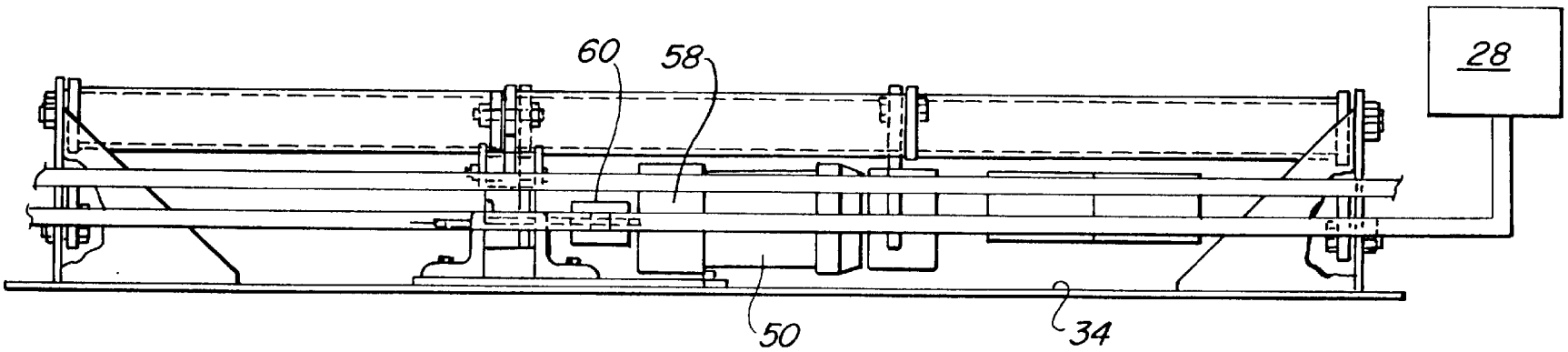
FIG. 5 is a front elevation view thereof.

Referring now to FIGS. 2, 4 and 5, a drop unit 22 for a wheelchair includes a platform 24. In the initial "up" position, the wheelchair platform 24 is flush with the theater floor 30. The platform 24 is rigidly attached to a subframe 32. A top link 40 and a bottom link 38 pivotably connect the subframe 32 to a base frame 34, in a parallelogram linkage. The base frame 34 is secured to the foundation 44 of the theater. A rubber (or other similar material) pad 46 is installed on top of the foundation directly beneath the subframe 32.

An electric motor 50 is mounted on the base frame 34. The shaft of the motor drives a coupler 60 through a gear reduction unit 58. A cam 52 is secured to the output shaft of the coupler 60. An armature 56 is attached to the top link 40 and extends down towards the cam 52. A roller 55 rotatably attached onto the end of the armature rides on the cam 52. The cam 52 has a lobe 57 with a steep trailing end 59, as shown in FIG. 2A. The coupler provides torsional dampening between the output shaft of the gear reduction unit and the cam.

In operation, the controller causes the motor 50 to drive the cam 52 in direction R shown in FIG. 2A, through the gear unit 58 and coupler 60. The cam lobe 57 pushes the armature 56 up as the lobe moves into a position under the roller 55. This in turn drives the top and bottom links 38 and 40 up causing the platform 24 to lift. The parallelogram linkage allows only purely vertical platform movement. When the wheelchair platform 24 reaches its "up" position a proximity sensor 62 senses the proximity of the subframe 32 to the floor 30. In response to the signal from the proximity sensor 62, the controller 28 stops the motor 50.

The wheelchair platform 24 is in the "up" position when the audience enters the theater and preferably stays in the "up" position during almost the entire film presentation. In the preferred embodiment, at the end of the film presentation, an explosion sequence takes place on screen. The controller 28 which is electrically linked to the film projection system, energizes the motor 50 briefly. The motor shaft turns the cam 52 through the gear reduction unit 58 and coupler 60. This causes the cam to rotate further in direction R, so that the lobe 57 passes the roller 55 and the roller drops down onto the trailing section 59 of the cam 52. As the roller 55 directly or indirectly supports the links 38 and 40, subframe 32 and the platform 24, these components also simultaneously drop down.

As a result, during the explosion sequence, the platform suddenly drops, providing the guests with a participatory experience with the explosion seemingly taking place all around them. Special effects, such as fog and lighting, help to enhance the illusion that the theater floor has been blown out by the explosion. The cam movement drops the sub frame 32 and platform 24 in a "freefall" by a preset amount, preferably about 1 inch. The amount of drop is determined by the specific geometry of the cam, and links 38 and 40.

The pad 46 beneath the subframe prevents excessive wear on the wheelchair drop unit 22 and also reduces shock transmission to the guests. The wheelchair platform assembly is advantageously then reset to the "up" position immediately after the drop event, while the guest's wheelchair is still on the platform. This maintains the platform level with the theater floor, to ease exiting from the theater. Resetting is achieved by the controller driving the motor in the direction R until the lobe 57 is once again directly under and supporting the roller 55. Rotary encoders linked to the output shaft of the coupler and the controller may be used to indicate the position of the cam.

Figure 3:
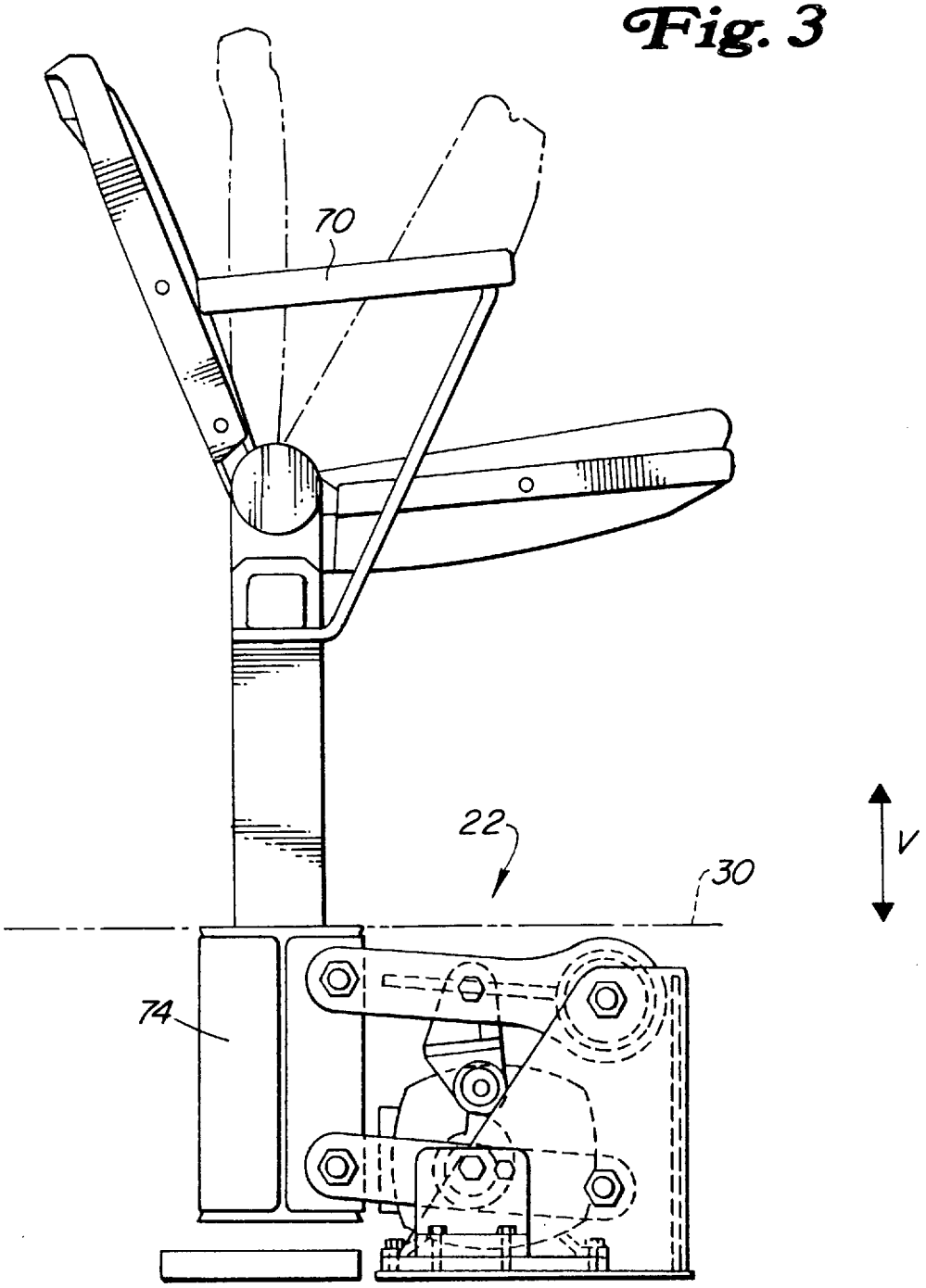
FIG. 3 is a side elevation view of conventional theater seats on a drop unit.

FIG. 3 shows a similar seat drop design for conventional theater seats. Several theater seats 70 are positioned on one or more seat drop units 22. In the preferred embodiment, each seat drop unit 22 supports a row of five to seven theater seats. The seat drop units 22 are installed beneath the floor 30 of the theater. The seat subframe 74 extends up through the theater floor to support the seats 70. The seat drop unit shown in FIG. 2 may be the same as the unit shown in FIG. 3. The unit 22 in FIG. 2 is attached to the wheelchair platform whereas the unit 22 in FIG. 3 is attached to the seat subframe 74. The operation of the theater seats, as shown in FIG. 3 is the same as described for FIG. 2. Each group or row of seats 70 drops together. It should be noted that any type of theatrical presentation (such as a show, concert, etc.) could be substituted for the film presentation and that the seat and wheelchair platform drop can occur at any point in the presentation. The direction of seat movement may also be changed as desired.

While the invention is susceptible to various modifications and alternative forms, specific examples have been shown in the drawings and are described in detail. It should be understood, however, that the invention is not limited to the particular forms or methods disclosed. Rather, the invention should intended to cover all modifications and alternatives falling within the spirit and scope of the claims and their equivalents.

What is claimed is:

1. A theater comprising:

an audience seating area;

a plurality of seats in the audience seating area;

means for vertically dropping and resetting the plurality of seats;

a generally flat wheelchair platform in the seating area adapted to support a wheelchair;

means for securing a wheelchair to said wheelchair platform; and means for vertically dropping and resetting the wheelchair platform.

2. A theater comprising:

an audience seating area;

a first drop unit in the audience seating area;

at least one seat attached to the first drop unit;

a second drop unit in the audience seating area;

at least one platform attached to the second drop unit;

at least one of the drop units including:

a base frame attached to a floor in the audience seating area;

a top link, a bottom link, and a subframe, with the top link and bottom link each pivotably attached to the base frame and the subframe;

a cam coupled to at least one of the bottom link, the top link, and the subframe; and means for turning the cam.

3. The theater of claim 2 wherein the means for turning comprises:

a motor coupled to the cam and supported on the base frame.

4. The theater of claim 2, further comprising:

an absorbing pad installed below the subframe.

5. The theater of claim 2, further comprising:

a sensor for directly or indirectly securing a position of the subframe.

6. The theater of claim 2, wherein the to top link, the bottom link, the subframe, and the base frame form a parallelogram linkage limiting movement of the subframe to single direction.

7. A theater comprising:

an audience seating area;

a first drop unit in the audience seating area;

at least one seat attached to the first drop unit;

a second drop unit in the audience seating area;

at least one wheelchair platform attached to the second drop unit;

means for securing a wheelchair to said at least one wheelchair platform;

at least one projection screen facing the audience seating area;

a projector for projecting a film onto the projection screen; and means for actuating the drop units to quickly drop the seat and platform at a predetermined scene in the film.

8. The theatre of claim 7 wherein the means for actuating is linked to the projector.

9. The theatre of claim 7 further comprising a controller linked to the means for actuating and to the projector.

10. The theatre of claim 9 wherein the controller comprises means for detecting the projection of a specific film sequence, and means for energizing the means for actuating, when the specific film sequence is detected.

11. A theatre comprising:

an audience seating area;

a first drop unit in the audience seating area;

at least one seat attached to the first drop unit;

a second drop unit in the audience seating area;

at least one wheelchair platform attached to the second drop unit;

means for securing a wheelchair to said at least one wheelchair platform; and means for automatically actuating the drop units to quickly drop the seat and platform at a predetermined time.

12. The theatre of claim 11 wherein the platform is flat and adapted to support a wheelchair.

13. The theatre of claim 12 wherein said means for securing comprises a rear stop on the platform for securing a wheelchair.

14. The theater of claim 11, further comprising means for resetting the drop units in an upward vertical direction to their starting position following the drop.

15. The theater of claim 11 further comprising;

at least one projection screen facing the audience seating area and means for projecting a film onto the projection screen.

16. The theater of claim 15, further comprising a controller linked to the means for actuating and to the means for projecting.

17. A theater comprising:

an audience seating area;

a drop unit in the audience seating area, the drop unit including:

a base frame attached to a floor in the audience seating area;

a top link, a bottom link, and a subframe, with the top link and bottom link each pivotably attached to the base fame and the subframe;

a cam coupled to at least one of the bottom link, the top link, and the subframe; and a means for turning the cam.

* * * * *